United States Patent [19]

Becker et al.

[11] Patent Number: 4,705,536

[45] Date of Patent: Nov. 10, 1987

[54] PARTIAL OXIDATION OF VANADIUM-CONTAINING HEAVY LIQUID HYDROCARBONACEOUS AND SOLID CARBONACEOUS FUELS

[75] Inventors: Michael W. Becker, Los Alamitos; John S. Stevenson, Gardena, both of Calif.; Mitri S. Najjar, Hopewell Junction, N.Y.

[73] Assignee: Texaco, Inc., White Plains, N.Y.

[21] Appl. No.: 902,838

[22] Filed: Sep. 2, 1986

[51] Int. Cl.[4] ..... C10J 3/46

[52] U.S. Cl. ..... 48/197 R; 48/212; 48/215; 75/24; 208/126; 208/127; 252/373

[58] Field of Search ..... 48/197 R, 202, 206, 48/210, 212, 215; 252/373; 75/24; 208/131, 163, 126, 127

[56] References Cited

U.S. PATENT DOCUMENTS

| | | | |
|---|---|---|---|
| 2,644,745 | 7/1953 | Hemminger | 48/203 |
| 2,702,240 | 2/1955 | Rees et al. | 75/26 |
| 2,920,936 | 1/1960 | Dille et al. | 48/215 |
| 2,932,561 | 4/1960 | Paull | 48/215 |
| 3,607,157 | 9/1971 | Schlinger et al. | 48/206 |
| 3,803,023 | 4/1974 | Hamner | 208/131 |
| 4,074,981 | 2/1978 | Slater | 252/373 |
| 4,277,365 | 7/1981 | Paull et al. | 252/373 |
| 4,328,008 | 5/1982 | Muenger et al. | 252/373 |
| 4,411,670 | 10/1983 | Morjon et al. | 48/215 |
| 4,424,065 | 1/1984 | Langhoff | 252/373 |

*Primary Examiner*—Peter Kratz

*Attorney, Agent, or Firm*—Robert A. Kulason; James J. O'Loughlin; Albert Brent

[57] ABSTRACT

Process for the production of gaseous mixtures comprising $H_2+CO$ e.g. synthesis gas, reducing gas, or fuel gas by the partial oxidation of a vanadium-containing liquid hydrocarbonaceous fuel, solid carbonaceous fuel, or mixtures thereof in a free-flow vertical refractory lined gas generator. The feed mixture to the gas generator comprises (i) a vanadium-containing fuel; (ii) supplemental iron-containing ash fusion temperature reducing agent; and (iii) at least a portion of the remainder of the iron-containing slag after separation of an enriched vanadium-containing coarse slag fraction. The coarse slag fraction has a decreased Fe/V weight ratio and is formed by depositing a portion of the slag entrained in the hot raw effluent gas stream from the partial oxidation reaction zone on the walls of a slag separation chamber located between the bottom discharge outlet in the reaction zone and the effluent gas quench tank located at the bottom of the gas generator. It is economically advantageous to recover by-product vanadium from the coarse slag fraction in a metal refining plant.

26 Claims, No Drawings

PARTIAL OXIDATION OF VANADIUM-CONTAINING HEAVY LIQUID HYDROCARBONACEOUS AND SOLID CARBONACEOUS FUELS

FIELD OF THE INVENTION

This invention relates to the partial oxidation of vanadium-containing liquid hydrocarbonaceous fuel, solid carbonaceous fuel and mixtures thereof. More particularly, it pertains to the partial oxidation of vanadium-containing heavy liquid hydrocarbonaceous fuel including petroleum derived liquid fuels; vanadium-containing solid carbonaceous fuel, e.g., petroleum coke, asphalt, tarsands, shale, and mixtures thereof, to produce gaseous mixtures comprising $H_2+CO$.

Liquid hydrocarbonaceous fuels such as petroleum products and slurries of solid carbonaceous fuels such as petroleum coke and shale are well known fuels for the partial oxidation process. Because of their comparatively low cost, it is desirable to use these materials as feedstock to the partial oxidation process, such as described in coassigned U.S. Pat. No. 3,607,157, which is incorporated herein by reference. However, the widespread use of these materials in the partial oxidation process may be encumbered by the contaminates which they may contain. For example, vanadium may be present in the ash of these materials in a minimum amount of 5.0 wt. %. The presence of vanadium compounds in the slag requires the gasifier to be run at a higher temperature. By this means the molten slag produced in the gasifier would have a suitable fluidity for easy discharge. However, it is more costly to operate a gasifier at higher reaction temperatures. Further, the life of the gasifier is reduced. By the subject process the gas generator may be operated at a lower temperature, and vanadium may be recovered as a useful and profitable by-product.

SUMMARY OF THE INVENTION

In accordance with certain aspects of the invention there is provided a partial oxidation process for the production of gaseous mixtures comprising $H_2+CO$ in the reaction zone of a downflowing gas generator, the improvement comprising:

(1) mixing together the following materials to produce a feed mixture (i) a vanadium - containing fuel selected from the group consisting of liquid hydrocarbonaceous fuel, a slurry of solid carbonaceous fuel, and mixtures thereof; (ii) supplemental iron-containing ash fusion temperature reducing agent; and (iii) at least a portion of the remainder of the iron-containing slag after separation of the coarse slag fraction in (5);

(2) reacting by partial oxidation in a refractory-lined free-flow unpacked reaction zone of said gas generator the vanadium-containing feed mixture from (1) to produce a hot raw effluent gas stream comprising $H_2+CO$ along with vanadium-containing molten slag and particulate matter;

(3) passing the hot raw effluent gas stream from (2) down through a coaxial discharge passage in the bottom of the reaction zone of said gas generator and then into a connecting slag separation chamber that is provided with a bottom outlet; depositing a portion of the slag entrained in said hot raw gas stream on the walls of said separation chamber and building up the thickness of said slag on the walls of said chamber until chunks of slag having a diameter in the range of about ¼ inch to 10.0 inches and an Fe/V weight ratio which is less than that of the feed mixture in (1) separate from the wall and fall into quench water contained in a quench tank located below the bottom outlet in said separation chamber;

(4) passing through said quench tank at least a portion of the hot raw effluent gas stream leaving said slag separation chamber to produce said gaseous mixture comprising $H_2+CO$, and solidifying molten slag and separating out in said quench tank slag and particulate matter that were entrained in said hot raw gas stream; and (5) passing the water and solids from the bottom of said quench tank into a water-solids separation zone, removing a portion of the water and recycling said water to the quench tank; and separating a coarse slag fraction from the remainder of the slag; wherein said coarse slag fraction has an Fe/V weight ratio which is less than that of the feed mixture in (1).

In another embodiment pertaining to the gasification of petroleum coke with an iron-containing ash-fusion temperature reducing additive; the petroleum coke is produced by coking a mixture of vanadium-containing liquid hydrocarbonaceous fuel, supplemental iron-containing additive and a recycle iron-containing coarse slag fraction. This petroleum coke, with the additive and recycle slag fraction uniformly dispersed throughout, is then reacted in the partial oxidation gas generator with a free-oxygen containing gas and in the presence of a temperature moderator to produce synthesis gas, reducing gas, or fuel gas.

By the subject process, the vanadium content of the recycled iron-containing ash fraction is substantially reduced. This recycle ash fraction is capable of picking up more vanadium upon being recycled and passed through the gasifier where the carbon values in the slag may be converted into more synthesis gas. Further, the amount of supplemental ash fusion temperature reducing agent is reduced. Savings in the cost of the additive and in disposal costs of slag are thereby effected. Further, the vanadium may be recovered as a valuable by-product.

DISCLOSURE OF THE INVENTION

The subject invention pertains to the use of vanadium-containing petroleum-based heavy liquid hydrocarbonaceous fuels, solid carbonaceous fuels and mixtures thereof, as feedstock to a free-flow partial oxidation gas generator. Synthesis gas, reducing gas and fuel gas may be produced using these comparatively low-cost fuels.

The partial oxidation of heavy liquid hydrocarbonaceous fuel and petroleum coke are described respectively in coassigned U.S. Pat. Nos. 4,411,670 and 3,607,156, which are incorporated herein by reference. Suitable free-flow refractory lined gas generators and burners that may be used in the production of synthesis gas, reducing gas, or fuel gas from these materials, are also described in the aforesaid references. Advantageously, the subject process uses relatively inexpensive feedstocks comprising petroleum-based heavy liquid hydrocarbonaceous fuel and/or petroleum coke feedstocks having vanadium-containing ashes. Further, said feedstocks include a minimum of 0.5 wt. % of sulfur, such as at least 2.0 wt. % sulfur: and, said ash includes a minimum of 2.0 wt. % of vanadium, such as about 7.0 to 35 wt. % and a minimum of 2.0 wt. % of nickel, such as about 7.0 to 35 wt. %. Up to about 5000 parts per million (ppm) or higher of silicon, such as about 50 to 300 ppm, say about 450 to 1000 ppm are also present in the feed.

By definition, vanadium-containing heavy liquid hydrocarbonaceous material or fuel is a petroleum derived fuel, selected from the group consisting of virgin crude, residua from petroleum distillation and cracking, petroleum distillate, reduced crude, whole crude, asphalt, shale oil, tar sand oil and mixtures thereof. Heavy liquid hydrocarbonaceous fuels with vanadium-containing ash include high boiling liquid petroleum feed to or the bottoms from a vacuum tower or a fractionator. By definition, the term vanadium-containing petroleum coke is petroleum coke, made from ash-containing heavy liquid hydrocarbonaceous fuel by conventional coking methods, such as by the delayed or fluid coking process such as described in coassigned U.S. Pat. No. 3,673,080 which is incorporated herein by reference. These materials contain a minimum of 11.0 parts per million (ppm) of vanadium.

Closer study of the ashes derived from the partial oxidation, without an additive, of a feedstock comprising heavy liquid hydrocarbonaceous fuels and/or petroleum coke having vanadium-containing ashes, shows that they are largely composed of oxide and sulfide compounds of vanadium, nickel, iron, along with some normally occurring mineral matter species. Vanadium-containing oxide laths are presently selected from the group consisting of V, V+Ca, V+Fe, V+Al, and mixtures thereof. Vanadium-containing spinels are present of the spinel-type aluminate phases with any metals selected from the group consisting of V, Fe, Cr, Al, Mg and mixtures thereof. The presence of abundant interlocking needle to lath-like crystals is the cause of the high viscosity of the slag.

The metals present in the ash provide a system that is significantly different from that occurring in coal. A further factor is that the total ash content of the petroleum coke or heavy liquid hydrocarbonaceous fuel may be only about 0.3 to 5 wt. %, whereas coal typically contains 10 to 20 wt. % ash. The comparatively low ash concentration in petroleum coke and heavy liquid carbonaceous fuel may be the reason why the ash removal problem is only noticed after prolonged gasifier runs. The likelihood for effective ash and additive mixing, that is necessary to wash the vanadium constituents out of the reaction zone or for effective fluxing is, therefore, greatly reduced.

It is theorized that, in the heavy liquid hydrocarbonaceous material and petroleum coke systems, a good deal of the ash material is liberated as individual molecular species. This is because, upon vacuum distillation or coking, the metallic species in the crude which are generally presented as porphyrin type structures (metal atoms, oxides or ions thereof confined in an organic framework), are entrapped within the collapsed carbon matrix.

Problems arise when the heavy metal constituents build up in the system. In particular, vanadium is known to accumulate on the walls of the refractory lined reaction zone of the partial oxidation gas generator and not flow smoothly from the gasifier under normal gasifier conditions. During shutdown and subsequent exposure of the gasifier walls to air, these deposits involving vanadium can catch fire, with the vanadium converting to the lower melting $V_2O_5$ or metal vanadate states. These materials prove to be very corrosive to refractory lining of the reaction zone. These problems, and others, are minimized by the subject process in which the amount of vanadium constituents in the reaction zone are substantially reduced.

In the process, a feed mixture is introduced into a free-flow unobstructed partial oxidation gas generator along with a free-oxygen containing gas and a temperature moderator. The feed mixture comprising (i) vanadium-containing liquid hydrocarbonaceous fuel, solid carbonaceous fuel, or mixtures thereof, (ii) supplemental iron-containing ash fusion temperature reducing agent, and (iii) a recycle portion of the slag produced in the gas generator and upgraded by removing therefrom a coarse fraction rich in vanadium. The Fe/V weight ratio of the coarse slag fraction is about 40% to 70% less than that of said feed mixture. The amount of supplemental iron-containing ash fusion temperature reducing agent make-up plus the recycle iron-containing slag is such as to provide the feed mixture with an Fe/V weight ratio in the range of about 5 to 50. The amount of iron in this feed mixture will assure the removal from the gas generator of sufficient vanadium so that the life of the refractory lining is extended, the slag flows freely from the gasifier, and the temperature in the reaction zone may be reduced.

The aforesaid ingredients (i), (ii), and (iii) of the feed mixture are preferably ground together in a conventional ball or rod mill. Alternatively, the ingredients may be ground separately or in pairs, and then mixed together. Preferably, the feed mixture has the following particle size distribution:

| U.S.A. Standard Series Sieve Designation | | |
|---|---|---|
| Alternative - (ASTM E11) | Microns | Percent Passing |
| 14 | 1400 | 99.9 |
| 40 | 425 | 99.5 |
| 200 | 75 | 65 |
| 325 | 45 | 45–55 |

The partial oxidation reaction takes place at a temperature in the range of about 1800° F. to 3000° F., such as about 2200° F. to 2800° F. and a pressure in the range of about 1 to 300 atmospheres, such as about 5 to 250 atmospheres. The atoms of free-oxygen plus atoms of organically combined oxygen in the fuel per atom of carbon in the fuel (O/C atomic ratio) may be in the range of about 0.5 to 1.95, such as about 0.8 to 1.3.

The term free-oxygen containing gas, as used herein, is intended to include air, oxygen-enriched air, i.e. greater than 21 mole % oxygen, and substantially pure oxygen i.e. greater than 95 mole % oxygen (the remainder comprising $N_2$ and rare gases).

The term temperature moderator as employed herein includes water, steam, $CO_2$, $N_2$, and a recycle portion of the cooled product gas stream. For example, the weight ratio of $H_2O$/fuel may be in the range of about 0.1 to 3.

The iron-containing ash-fusion temperature reducing agent includes an inorganic or organic compound of iron. The iron-containing ash-fusion temperature reducing agent contains iron compounds selected from the group consisting of oxides, sulfides, sulfates, carbonates, cyanides, nitrates and mixtures thereof. Optionally, included in the iron-containing ash-fusion temperature reducing agent is an additional material selected from the group of elements consisting of calcium, fluorine, magnesium, chromium, and mixtures thereof.

The raw product gas produced in the gasifier comprises mixtures of $H_2+CO$, along with other gaseous materials, e.g. $H_2O$, $CO_2$, $N_2$, $CH_4$, $H_2S$, COS, and entrained molten slag and particulate matter e.g. unconverted carbon. Depending on the relative amounts of $H_2$, CO and $CH_4$, the raw product gas stream may be called synthesis gas, reducing gas, or fuel gas. For example, synthesis gas has various $H_2/CO$ mole ratios required for catalytic synthesis of organic chemicals. Reducing gas may be rich in $H_2$, and fuel gas contains $CH_4$ in admixture with the $H_2$ and CO.

The downflow gas generator is a vertical cylindrical shaped refractory lined pressure vessel free-from packing or catalyst. Coaxially aligned along the vertical central axis is an inlet port in the upper head. A burner for introducing and mixing together the feedstreams is mounted in this inlet port. The burner discharges into a refractory lined coaxial reaction zone which has a restricted bottom coaxial outlet or passage. The bottom outlet discharges into a coaxial refractory lined free-flow slag separation chamber. The volume of the slag separation chamber is substantially smaller than that of the reaction zone. The slag separation chamber may have a vertical cylindrical shape with coaxial inlet and outlet ports along the vertical longitudinal axis. The top of the slag separation chamber may be hemispherical or a diverging frusto-conical shaped dome. The slag separation chamber may have a converging hemispherical or converging frusto-conical bottom that discharges through a restricted orifice or passage and into a quench tank containing a pool of quench water in the bottom of the vessel. Alternatively, the slag separation chamber may be a refractory lined hollow sphere or hemisphere with coaxial vertical inlet and outlet ports.

The temperature of the hot raw effluent gas stream passing through the slag separation chamber and into the quench tank is in the range of about 2200° F. to 3000° F. while the temperature of the refractory walls of the slag separation chamber is lower e.g. in the range of about 1800° F. to 2500° F. The dwell time in the slag separation chamber is in the range of about 0.05 to 0.50 seconds. Further, from about 1.0 to 25 wt. % of the molten slag entrained in the hot raw gas stream separates out in the slag separation chamber. The remainder of the molten slag is carried into the quench water along with the hot raw effluent gas stream and solidifies. The slag builds up on the walls of the slag separation chamber until chunks having a diameter in the range of about ¼ inch to 10.0 inches separate from the wall by gravity with or without help from a jet of gas and falls into the quench water contained in the quench tank below. Suitable jets of gas may be selected from the group consisting of $N_2$, $CO_2$, $H_2O$, and recycle product gas. In the preferred embodiment, the slag separation chamber has a single outlet which is in the bottom of the slag separation vessel and which is coaxial with the vertical central axis. All of the hot raw effluent gas stream passes through this bottom outlet and passes into the quench vessel.

In another embodiment, the arrangement of the reaction zone, slag separation chamber, and quench tank is similar to that shown in coassigned U.S. Pat. Nos. 4,289,502 and 4,328,006, which are incorporated herein by reference.

In this embodiment, an outlet is provided in the side of the slag separation chamber for removing a portion e.g. about 1 to 99 volume % of the hot effluent gas stream, and cooling said portion of hot effluent gas in a gas cooler, such as in a waste heat boiler. The remainder of the hot effluent gas stream passes through the bottom outlet in the slag separation chamber. By this means the bottom outlet is kept hot. Slag is thereby prevented from freezing and plugging up the bottom outlet of the slag separation chamber.

One embodiment of the slag separation chamber comprises a plurality of coaxial hollow vertical cylinders of increasing diameter in tandem. In still another embodiment, the slag separation chamber is a hollow refractory lined vertical cylinder having a length to diameter ratio in the range of about 0.25 to 3.0 such as about 0.4 to 1.0; and the ratio of the diameter of the discharge passage in the bottom of the gas generator to the diameter of the slag separation chamber is in the range of about 0.3 to 0.8.

The hot effluent gas stream leaving the slag separation zone by way of the coaxial bottom outlet passes directly into the quench tank containing quench water. The quench tank is located at the bottom of the gas generator and may be part of the same pressure vessel; or, it may be a separate vessel. Optionally, the hot gas stream may be introduced under the water level in the quench tank by means of a dip tube, as shown in coassigned U.S. Pat. No. 4,328,006. The cooled clean stream of $H_2+CO$ containing gas is removed by way of an outlet in the side of the quench tank above the water level.

The slag and particulate solids are separated from the water in the quench tank and a portion of the water is recycled to the quench tank in a water-solids separation zone. Thus, periodically, ash and solid particulate matter are removed from the bottom of the quench tank while maintaining the system pressure by means of a conventional lockhopper system such as that shown in coassigned U.S. Pat. Nos. 4,247,302 and 4,533,363 which are incorporated herein by reference. Optionally, prior to being introduced into the lockhopper system any larger pieces of slag in the aqueous slurry leaving the quench tank may be crushed to a maximum size of about 2"-3" by means of a conventional in-line slag crusher. For example, see coassigned U.S. Pat. No. 4,472,171, which is incorporated herein by reference.

In the water-solids separation zone selected from the group of equipment consisting of lockhopper, hydroclone, filter, clarifier, sieves, settler, and combinations thereof, ash is separated from the quench water. It was unexpectedly found that all of a coarse slag fraction as separated thereby, and which is comprised of all the slag particles of a size equal to or greater than that retained by ASTM E11 U.S.A. Standard Series Sieve Designation Alternative 3.5, has an Fe/V weight ratio in a range of about 40% to 70% less than that of the feed mixture to the partial oxidation gas generator. The coarse fraction comprises about 1 to 25 weight percent, such as about 2 to 15 wt. % of the total slag. American Society For Testing and Materials Standard E 11 (ASTM E11) is incorporated herein by reference.

Since the coarse slag fraction originated from slag that built up on the walls of the slag separation chamber, it is suggested that by some unknown mechanism, unexpectedly, vanadium in the feedstream is released and concentrated in the slag lining the walls of the slag separation chamber. It is economically attractive to recover by-product vanadium from this coarse slag fraction by conventional methods in a metals reclaiming process or facility. Further, it was unexpectedly found that the remaining slag fraction after separation of said coarse slag fraction by conventional means e.g. sieves has a particle size distribution which passes through ASTM E 11 U.S.A. Standard Series Sieve Designation Alternative No. 3½ to No. 325, and below. Further, the remaining slag fraction has an Fe/V weight ratio in the range about equal to that of the feed mixture to the partial oxidation gas generator to 250% greater than that of said feed mixture. The increased Fe/V weight ratio for this fraction of slag is due to the removal of vanadium with the coarse slag fraction that originated on the walls of the slag separation chamber. It is economically attractive to dewater at least a portion of the vanadium-deficient remaining slag fraction after separating the coarse slag fraction and recycle it for mixing and/or grinding with fresh vanadium-containing fuel and supplemental iron-containing ash fusion temperature reducing agent to produce the feed mixture to the partial oxidation gas generator. For example, in the feed mixture to the partial oxidation gas generator the weight ratio of the remaining slag fraction after separation of the coarse slag fraction to the sum of said remaining slag fraction and the supplemental iron-containing ash fusion temperature reducing agent is in the range of about 0.25 to 0.90.

In another embodiment, the feed mixture comprises (i) vanadium-containing heavy liquid hydrocarbonaceous fuel, (ii) supplemental iron-containing ash-fusion temperature reducing agent, and (iii) and iron-containing slag fraction as subsequently produced in the process comprising at least a portion of the remainder of the slag after separation of a coarse slag fraction and whose Fe/V weight ratio is about 40% to 70% less than that of the subject feed mixture. This feed mixture at a temperature in the range of about 650° F. to 930° F. is introduced into a delayed coking zone where at a temperature in the range of about 800° F. to 895° F. and a pressure in the range of about 20 to 60 psig, uncondensed hydrocarbon effluent vapor and steam are removed overhead and petroleum coke having a vanadium-containing ash and having uniformly dispersed therein said iron-containing additive materials (ii) and (iii) is removed from the bottom.

Alternatively, the previously described feed mixture at a temperature in the range of about 550° F. to 750° F. is introduced into a fluidized bed coking zone where at a temperature in the range of about 1000° F. to 1200° F. and a pressure in the range of about 10 to 20 psig, uncondensed hydrocarbon effluent vapor and steam are removed overhead and petroleum coke having a vanadium-containing ash and having uniformly dispersed therein said iron-containing additive materials (ii) and (iii) is removed from the bottom.

The petroleum coke produced in the delayed or fluidized bed coking zones, as previously described has a Fe/V weight ratio in the range of about 5 to 50. The petroleum coke is introduced into a partial oxidation reaction zone as a pumpable slurry of petroleum coke in water, liquid hydrocarbonaceous fluid or mixtures thereof, or as substantially dry petroleum coke entrained in a gaseous transport medium, e.g. $H_2O$, $CO_2$, recycle product gas. The remaining steps in the partial oxidation process for the production of gaseous mixtures comprising $H_2+CO$ by the gasification of petroleum coke with iron-containing ash-fusion temperature reducing agent and recycle vanadium deficient iron-containing slag dispersed therein are substantially the same as described previously. The apparatus is also the same.

The coarse slag fraction which is separated from the remaining slag fraction for example by sieve in a slag sizing zone has a Fe/V weight ratio of about 40% to 70% less than that of the feed mixture to the coking zone, or the petroleum coke produced in the coking zone. The remainder of the iron-containing slag after the separation of the coarse slag fraction in slag sizing zone has an Fe/V weight ratio in a range about equal to that of the feed mixture to the coking zone or the petroleum coke produced to 250% greater than that of said feed mixture or the petroleum coke produced. Optionally, by-product vanadium may be recovered from the course slag fraction in a separate metals reclaiming process or facility. This step is economically attractive. The sizes of the coarse slag fractions produced in both embodiments of the process are substantially the same. This also applies to the other slag fractions separated.

The following example illustrates a preferred embodiment of this invention. While a preferred mode of operation is illustrated, the Example should not be construed as limiting the scope of the invention.

EXAMPLE

An aqueous slurry feed to a partial oxidation gas generator comprises the following:

| | wt. % |
|---|---|
| (i) petroleum coke | 62.8 |
| (ii) iron oxide-rich additive | 1.5 |
| (iii) recycle upgraded iron-containing slag fraction after removal of coarse slag fraction | 2.1 |
| (iv) water | 33.6 |

The solid composition of said aqueous slurry contains 1.045 wt. % Fe and 0.0745 wt. % V, and has an Fe/V weight ratio of 14.0. Solid materials (i), (ii) and (iii) are simultaneously ground and slurried with water to produce a slurry with the following particle size distribution:

| U.S.A. Standard Series Sieve Designation | | |
|---|---|---|
| Alternative - ASTM Ell | Microns | Percent Passing |
| No. 14 | 1400 | 99.9 |
| No. 40 | 425 | 99.5 |
| No. 200 | 75 | 65 |
| No. −325 | 45 | 45–55 |

The feed is subjected to partial oxidation in a refractory lined free-flow reaction zone at a temperature of about 2700° F. The gas-slag mixture exits from the bottom of the reaction zone through a 4 inch diameter throat 6 inches long. The gas-slag mixture then enters a vertical cylindrical shaped slag separation chamber 11 inches in diameter and 6 inches long. The thickness of the slag on the walls of the separation chamber is about 0.25 to 4 inches. The temperature of the walls of the separation chamber ranges from about 2400° F. near the top of the slag separation chamber to about 1900° F. near the bottom of the slag separation chamber. The dwell time in the slag separation chamber is 0.15 seconds. Pieces of slag drop by gravity through the 11 inches diameter outlet throat in the bottom of the separation chamber and into the quench water contained in the bottom of the quench tank located below the slag separation chamber. Further, all of the raw effluent gas stream passes through said outlet throat along with said slag.

The slag is recovered and screened. A coarse fraction of the slag comprising about 4 wt. % of the total slag is comprised of all of the slag particles of a size equal to or greater than that retained by ASTM E11 U.S.A. Standard Series Sieve Designation Alternative 3½. Unexpectedly, the composition of the solids in the coarse slag fraction in weight percent comprises iron 28 and vanadium 5.2. The Fe/V weight ratio is 5.5. The remainder of the slag after separating the coarse slag fraction has a particle size distribution which passes through ASTM E11 U.S.A. Standard Series Sieve Designation Alternative No. 3½ to No. 325 and below. Unexpectedly, the composition of the solids in this second slag fraction in weight percent comprises iron 32.0 and vanadium 1.2. The Fe/V weight ratio of this second slag fraction is 27. At least a portion of the second slag fraction is dewatered and recycled and ground with materials (i) and (ii) as previously described. At least a portion of the coarse slag fraction is sent to a metals refining plant to reclaim vanadium.

In another run, said second slag fraction is screened. About 30.0 wt. % of the total slag has a particle size distribution which passes through ASTM E11 U.S.A. Standard Series Sieve Designation Alternative No. 3½ to No. 12. Unexpectedly, the composition of the solids in this third slag fraction in weight percent comprises iron 45.7 and vanadium 2.6. The Fe/V weight ratio is 18.

The aforesaid data clearly shows that unexpectedly, for the particle sizes of slag screened the Fe/V weight ratio varies inversely with the particle size of the ash fraction. Further, in comparison with Fe/V wt. ratio of the aqueous slurry feed to the gas generator e.g. 14.0, the Fe/V wt. ratio of the coarse slag fraction is less e.g. 5.5, while that of the second and third fractions are respectively greater e.g. 27 and 18. By the subject process, vanadium may be concentrated in a coarse ash fraction. The coarse ash fraction may be then separated by screening from the remainder of the ash. The remainder of the ash may be recycled to the gas generator where it is mixed with fresh petroleum coke feed and supplemental iron oxide-rich additive. Optionally, the coarse ash fraction is sent to an external conventional metals reclaiming process or facility where by-product vanadium metal is recovered.

Various modifications of the invention as herein before set forth may be made without departing from the spirit and scope thereof, and therefore, only such limitations should be made as are indicated in the appended claims.

We claim:

1. In a partial oxidation process for the production of gaseous mixtures comprising $H_2+CO$ in the reaction zone of a down flowing gas generator, the improvement comprising:

(1) mixing together the following materials to produce a feed mixture, (i) a vanadium-containing fuel selected from the group consisting of liquid hydrocarbonaceous fuel, a slurry of solid carbonaceous fuel, and mixtures, thereof;. (ii) supplemental iron-containing ash fusion temperature reducing agent containing iron compounds selected from the group consisting of oxides, sulfides, sulfates, carbonates, cyanides, nitrates and mixtures thereof; and (iii) at least a portion of the remainder of the iron-containing slag after separation of the coarse slag fraction in (5); wherein said vanadium-containing liquid hydrocarbonaceous fuel is a petroleum derived liquid fuel selected from the group consisting of whole crude, residua from petroleum distillation and cracking, petroleum distillate, reduced crude, asphalt, shale oil, tar sand oil, and mixtures thereof; and said vanadium containing solid carbonaceous fuel is selected from the group consisting of petroleum coke, asphalt, tarsands, shale, and mixtures thereof; and wherein vanadium is present in the ash in said liquid and solid fuels in a minimum amount of 2.0 weight %; said feed mixture has an Fe/V weight ratio in the range of about 5.0 to 50; and the weight ratio of said remainder of the iron-containing slag after separation of the coarse slag fraction to the sum of said remainder of the iron-containing slag after separation of the coarse slag fraction and said supplemental iron-containing ash fusion temperature reducing agent is in the range of about 0.25 to 0.90;

(2) reacting by partial oxidation said feed mixture with a free-oxygen containing gas in the presence of a temperature moderator in a refractory-lined free-flow unpacked reaction zone of said gas generator the vanadium-containing feed mixture from (1) to produce a hot raw effluent gas stream comprising $H_2+CO$ along with vanadium-containing molten slag and particulate matter;

(3) passing the hot raw effluent gas stream from (2) at a temperature in the range of about 2200° F. to 3000° F. and a pressure in the range of about 1 to 300 atmospheres down through a coaxial discharge passage in the bottom of the reaction zone of said gas generator and then into a connecting refractory-lined slag separation chamber that is provided with a bottom outlet; depositing a portion of the slag entrained in said hot raw gas stream on the walls of said separation chamber and building up the thickness of said slag on the walls of said chamber until chunks of slag having a diameter in the range of about ¼ inch to 10 inches and an Fe/V weight ratio which is less than that of the feed mixture in (1) separate from the wall and fall into quench water contained in a quench tank located below the bottom outlet in said separation chamber; wherein the temperature of the refractory walls of the slag separation chamber is lower than that of the hot raw effluent gas stream, the dwell time in the slag separation chamber is in the range of about 0.05 to 0.5 seconds, and from about 1.0 to 25.0 wt. % of the molten slag entrained in the hot raw gas stream separates out in the slag separation chamber;

(4) passing through said quench tank at least a portion of the hot effluent gas stream leaving said slag separation chamber and containing entrained molten slag to produce said gaseous mixture comprising $H_2+CO$, and solidifying molten slag and separating out in said quench tank slag and particulate matter that were entrained in said hot raw gas stream; wherein the Fe/V weight ratio of the slag entrained in the effluent gas stream leaving said slag separation chamber is greater than and the particle size is smaller than that of the slag which builds up on the walls of said slag separation chamber and falls into the quench tank; and (5) passing the water and solids from the bottom of said quench tank into a water-solids separation zone; removing a portion of the water from said vessel and recycling said water to the quench tank; and separating a coarse iron-containing slag fraction from the remainder of the slag having a smaller particle size wherein said coarse slag fraction has an Fe/V weight ratio which is about 40% to 70% less than that of the feed mixture in (1), and the remainder of the slag after separation of the coarse slag fraction has an Fe/V weight ratio in a range about equal to that of the feed mixture in (1) to 250% greater than that of the feed mixture in (1).

2. The process of claim 1 wherein all of the coarse slag fraction separated in (5) is comprised of all of the slag particles of a size equal to or greater than that retained by ASTM E11 U.S.A. Standard Series Sieve Designation Alternative 3½.

3. The process of claim 1 wherein the feed mixture in (1) has the following particle size distribution:

| U.S.A. Standard Series Sieve Designation | | |
|---|---|---|
| Alternative - ASTM E11 | Microns | Percent Passing |
| No. 14 | 1,400 | 99.9 |
| No. 40 | 425 | 99.5 |
| No. 200 | 75 | 65 |
| No. 325 | 45 | 45–55 |

4. The process of claim 1 wherein the slag separation chamber in (3) has the shape of a hollow sphere, hemisphere, or vertical cylinder with coaxial inlet and outlet ports along the vertical longitudinal axis.

5. The process of claim 1 wherein the slag separation chamber in (3) comprises a plurality of coaxial hollow vertical cylinders of increasing diameter in tandem.

6. The process of claim 1 wherein the slag separation chamber in (3) is a hollow refractory lined vertical cylinder, having a length to diameter ratio in the range of about 0.25 to 3.0, such as 0.4 to 1.0 and the ratio of the diameter of the discharge passage in the bottom of the gas generator to the diameter of the slag separation chamber is in the range of about 0.3 to 0.8.

7. The process of claim 1 wherein the feed materials (i), (ii), and (iii) are ground together to produce said feed mixture.

8. The process of claim 1 wherein the temperature of the refractory walls of the slag separation chamber in (3) is in the range of about 1800° F. to 2500° F. .

9. The process of claim 1 wherein slag on the walls of the slag separation chamber in (3) separates from the wall by gravity with or without help from a jet of gas.

10. The process of claim 1 wherein the water-solids separation zone in (5) is selected from the group of equipment consisting of lockhopper, hydroclone, filter, clarifier, sieves, settler, and combinations thereof.

11. The process of claim 1 provided with the steps of dewatering at least a portion of the remainder of the slag after separation of the coarse slag fraction in (5), and grinding said portion with supplemental iron-containing ash-fusion temperature reducing agent and fresh vanadium-containing fuel to produce the feed mixture in (1).

12. The process of claim 1 provided with the step of recovering vanadium from said coarse slag fraction separated in (5) in a metals reclaiming zone.

13. The process of claim 1 where included in the supplemental iron-containing ash-fusion temperature reducing agent in (1) is an additional material selected from the group of elements consisting of calcium, fluorine, magnesium, chromium and mixtures thereof.

14. The process of claim 1 provided with the step of reducing the size of the solids from the bottom of the quench tank to a maximum of about 2 inches to 3 inches.

15. The process of claim 1 wherein the slag separation chamber in (3) is provided with a side outlet in addition to said bottom outlet, and the hot raw effluent gas stream is divided between said bottom and side outlets.

16. The process of claim 1 with the step of removing a portion of the hot effluent gas stream from the slag separation chamber in (3) by way of an outlet in the side of said slag separation chamber, and cooling said portion of hot effluent gas in a gas cooler.

17. A partial oxidation process for the production of gaseous mixtures comprising $H_2+CO$ in a vertical free-flow down flowing gas generator said process comprising:

(1) mixing together (i) a vanadium-containing heavy liquid hydrocarbonaceous fuel, (ii) supplemental iron-containing ash-fusion temperature reducing agent containing iron compounds selected from the group consisting of oxides, sulfides, sulfates, carbonates, cyanides, nitrates and mixtures thereof, and (iii) at least a portion of the remainder of the iron-containing slag fraction after separation of the coarse slag fraction in (7); wherein said vanadium-containing liquid hydrocarbonaceous fuel is a petroleum derived liquid fuel selected from the group consisting of whole crude, residua from petroleum distillation and cracking, petroleum distillate, reduced crude, asphalt, shale oil, tar sand oil, and mixtures thereof; and wherein said feed mixture has an Fe/V weight ratio in the range of about 5.0 to 50; and the weight ratio of said remainder of the iron-containing slag fraction after separation of the coarse slag fraction and said supplemental iron-containing ash fushion temperature reducing agent is in the range of about 0.25 to 0.90;

(2) coking said mixture from (1) to produce petroleum coke having vanadium-containing ash and having dispersed therein said materials (1) (ii) and (1) (iii); wherein the Fe/V weight ratio of said petroleum coke is in the range of about 5 to 50;

(3) introducing the petroleum coke from (2) into the partial oxidation reaction zone in (4) as a pumpable slurry of petroleum coke in water, liquid hydrocarbonaceous fluid or mixtures thereof, or as substantially dry petroleum coke entrained in a gaseous transport medium;

(4) reacting said petroleum coke from (3) at a temperature in the range of 2200° F. to 3000° F. and a pressure in the range of about 5 to 250 atmospheres in a free-flow refractory lined partial oxidation reaction zone of a gas generator with a free-oxygen containing gas in the presence of a temperature moderator and in a reducing atmosphere to produce a hot raw effluent gas stream comprising $H_2+CO$ and entrained vanadium-containing molten slag and particulate matter;

(5) passing the hot raw effluent gas stream from (4) down through a coaxial discharge passage in the bottom of the reaction zone of said gas generator and then into a refractory lined slag separation chamber; depositing a portion of the slag entrained in said hot raw gas stream on the walls of said slag separation chamber and building up the thickness of the said slag on the walls of said chamber until chunks of slag having a diameter in the range of about ¼ inch to 10 inches and an Fe/V weight ratio of 40% to 70% less than the Fe/V weight ratio of the petroleum coke produced in (2) separate from the wall and fall into quench water contained in a quench tank located below said slag separation chamber; wherein the temperature of the refractory walls of the slag separation chamber is lower than that of the hot raw effluent gas stream, the dwell time in the slag separation chamber is in the range of about 0.05 to 0.5 seconds, and from about 1.0 to 25.0 wt. % of the molten slag entrained in the hot raw gas stream separates out in the slag separation chamber;

(6) passing through said quench tank at least a portion of the hot effluent gas stream leaving said slag separation chamber and containing entrained molten slag to produce said gaseous mixture comprising $H_2+CO$, and solidifying molten slag and separating out in said quench tank slag and particulate matter that were entrained in said hot raw gas stream; wherein the Fe/V weight ratio of the slag entrained in the effluent gas stream leaving said slag separation chamber is greater than and the particle size is smaller than that of the slag which builds up on the walls of said slag separation chamber and falls into the quench tank; and (7) passing the water and solids from the bottom of said quench tank into a water-solids separation zone; removing a portion of the water from said vessel and recycling said water to the quench tank; and separating a coarse iron-containing slag fraction from the remainder of the slag having a smaller particle size; wherein said coarse slag fraction has an Fe/V weight ratio which is less than that of the petroleum coke in (2); and the remainder of the slag after separation of the coarse fraction has an Fe/V weight ratio in a range about equal to that of the feed mixture in (1) to 250% greater than that of the feed mixture in (1).

18. The process of claim 17 where in (2) the mixture from (1) at a temperature in the range of about 650° F. to 930° F. is introduced into a delayed coking zone where at a temperature in the range of about 800° F. to 895° F. and a pressure in the range of about 20 to 60 psig, uncondensed hydrocarbon effluent vapor and steam are removed overhead and said petroleum coke having a nickel and vanadium-containing ash and having uniformly dispersed therein said iron-containing additive is removed from the bottom.

19. The process of claim 17 where in (2) the mixture from (1) at a temperature in the range of about 550° F. to 750° F. is introduced into a fluidized bed coking zone where at a temperature in the range of about 1000° F. to 1200° F. and a pressure in the range of about 10 to 20 psig, uncondensed hydrocarbon effluent vapor and steam are removed overhead and said petroleum coke is removed from the bottom.

20. The process of claim 17 where included in the supplemental iron-containing ash-fasion temperature reducing agent in (1) is an additional material selected from the group of elements consisting of calcium, fluorine, magnesium, chromium and mixtures thereof.

21. The process of claim 17 wherein the water-solids separation zone in (7) is selected from the group consisting of lockhopper, hydroclone, filter, clarifier, sieves, settler, and combinations thereof.

22. The process of claim 17 provided with the step of reducing the size of the solids from the bottom of the quench tank to a maximum of about 2 inches to 3 inches.

23. The process of claim 17 wherein the coarse slag fraction separated in (7) is comprised of all of the slag particles of a size equal to or greater than that retained by ASTM ETI U.S.A. Standard Series Sieve Designation Alternative 3½.

24. The process of claim 17 wherein the petroleum coke in (3) has the following particle size distribution:

| U.S.A. Standard Series Sieve Designation | | |
|---|---|---|
| Alternative - ASTM E11 | Microns | Percent Passing |
| No. 14 | 1,400 | 99.9 |
| No. 40 | 425 | 99.5 |
| No. 200 | 75 | 65 |
| No. 325 | 45 | 45–55 |

25. The process of claim 17 with the step of removing a portion of the hot effluent gas stream from the slag separation chamber in (5) by way of an outlet in the side of said slag separation chamber, and cooling said portion of hot effluent gas in a gas cooler.

26. The process of claim 17 provided with the step of recovering vanadium from said coarse slag fraction in (7) in a metals reclaiming zone.

* * * * *